United States Patent [19]

Skinner

[11] Patent Number: 4,632,342

[45] Date of Patent: Dec. 30, 1986

[54] GUTTER SYSTEM

[75] Inventor: James Skinner, Mississauga, Canada

[73] Assignee: Daymond, division of Redpath Industries Limited, Mississauga, Canada

[21] Appl. No.: 680,887

[22] Filed: Dec. 12, 1984

[51] Int. Cl.[4] ..... E04D 13/06

[52] U.S. Cl. ..... 248/48.2; 52/11

[58] Field of Search ..... 248/48.1, 48.2; 52/11, 52/12, 13, 14, 15

[56] References Cited

U.S. PATENT DOCUMENTS

| | | | |
|---|---|---|---|
| 2,187,869 | 1/1940 | Tobin | 248/48.1 |
| 3,022,029 | 2/1962 | Blayden | 248/48.2 |
| 3,189,027 | 6/1965 | Vranyosovics | 248/48.2 |
| 3,296,749 | 1/1967 | Cotter | 52/11 |
| 3,612,453 | 10/1971 | Zimmer | 52/11 X |
| 3,864,882 | 2/1975 | Lasscock | 52/11 |
| 3,913,284 | 10/1975 | Hall | 52/11 |

FOREIGN PATENT DOCUMENTS

| | | | |
|---|---|---|---|
| 683196 | 3/1964 | Canada | 52/11 |

*Primary Examiner*—J. Franklin Foss

*Attorney, Agent, or Firm*—James D. Fornari; Ivor M. Hughes

[57] ABSTRACT

A gutter section of plastics material comprising front and rear walls and a bottom, the front and rear walls carrying fastening elements for being removably secured to complementary fastening elements of a hanger bracket and a raised bead or projection on the inner surface of the rear wall extending in the same direction as the top of the rear wall and spaced therefrom whereby when a hanger bracket is secured to the gutter section, a hanger bracket engages the bead or projection on the rear wall of the gutter to rigidify the structure and permit ease of expansion and contraction of the gutter section relative to any hanger brackets supporting the gutter section.

41 Claims, 13 Drawing Figures

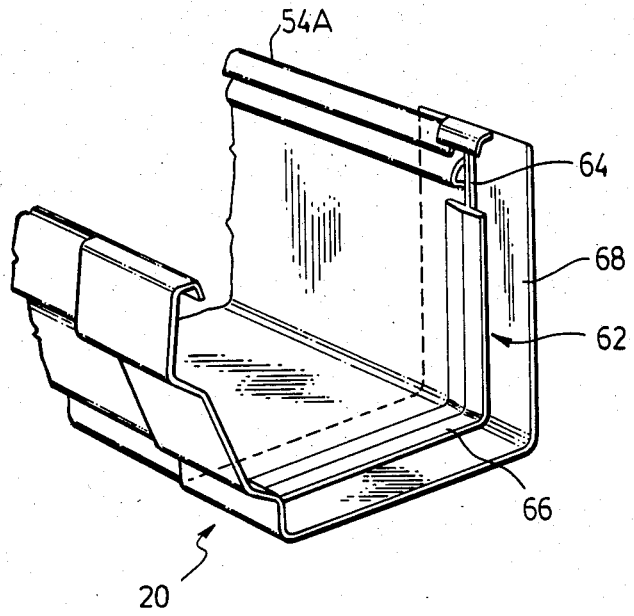
FIG. 7.
FIG. 8.
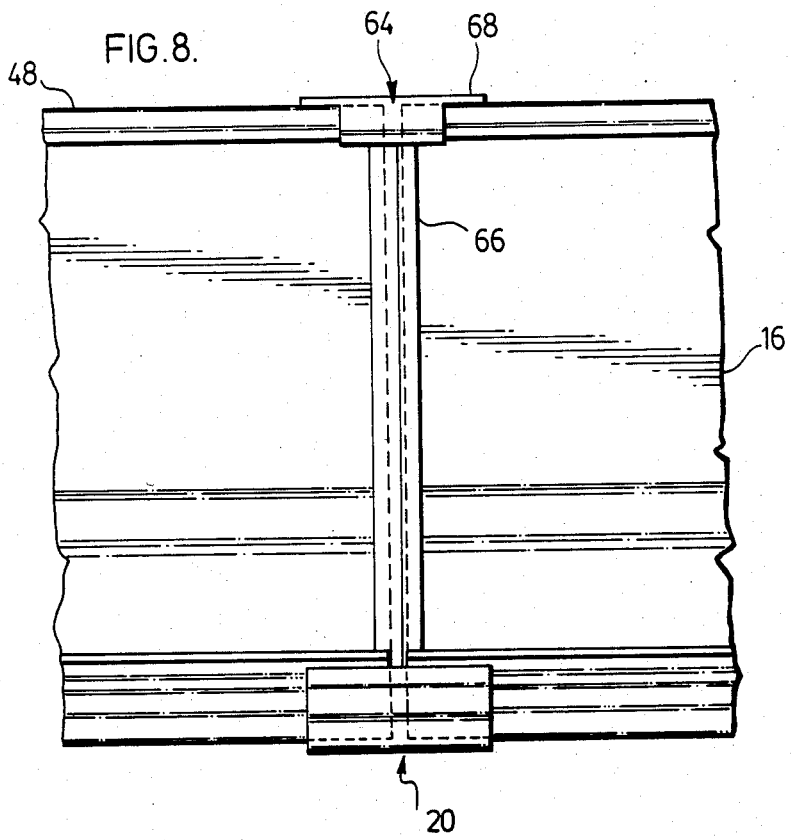

GUTTER SYSTEM

FIELD OF INVENTION

This invention relates to rain gutter system components including an improved gutter system of plastics material and hanging bracket for attaching said gutter to the eaves of a roof.

BACKGROUND OF INVENTION

Gutters attached to the eaves of a roof for channeling water and debris flowing off a roof are customarily composed of horizontal gutters, support brackets attached to the eaves of the roof and attached transversely to the horizontal gutters for supporting or suspending same, and downspout. Normally, such components are constructed from substantially non-expandable material, for example, a metal such as aluminum or galvanized steel. In recent years, expandable thermoplastics materials such as vinyl have become acceptable materials from which to construct the various gutter, support bracket and downspout components of a gutter system.

Normally, horizontal support brackets secure the back walls of the metal gutter flush with the fascia board of the eaves by means of a nail or screw extending through the gutter and the horizontal support bracket into the fascia board. For example, U.S. Pat. No. 3,053,491 to Ramser discloses a cantilever type horizontal support bracket and an associated gutter normally mounted on a building fascia board by a fastener, such as a nail, which extends through a U-shaped bend in the support bracket and the gutter rear wall interposed in the vertically oriented U-shaped bend, into the fascia board. The cantilever bracket because of its cantilever construction, supports the front wall of the gutter against sagging or bending downwardly relative to the rear wall of the gutter.

U.S. Pat. No. 3,150,851 (Ritchie) relates to a hanger for mounting metal gutters, the hanger comprising a vertical strap which is nailed or screwed to the fascia board and has upper and lower flanges which longitudinally grip the rear wall of the gutter and a clip which passes over the top of the gutter and interlocks with the strap and the front edge of the gutter. While the back wall of the gutter is not secured by a nail to the strap and fascia board, the clip disclosed provides only tension support to the front edge of the gutter and thus does not offer the strength of a substantially rigid bracket of the cantilever type.

Where gutters are constructed of expandable thermoplastics materials it is necessary to devise a coupling for the gutter and support bracket therefor, which permits the contiguous surfaces of such components to be slideably engaged when connected to permit the longitudinal expansion and contraction of the gutter with respect to the support bracket which is secured to a fascia board. U.S. Pat. No. 3,913,284 (Hall) teaches guttering made from plastic extrusions having a high coefficient of expansion and a bracket resembling a vertically oriented and inverted U-shaped bend with a flange extending diagonally upwardly away from the bottom of such inverted U-shaped bend, permitting one vertical web of the U-shaped bend to be screwed or nailed to a fascia board and to receive the rear wall of the gutter slideably inserted between the web 32 and the return flange 33. In this patent the diagonal flange 31 provides only tension support for the front edge of the gutter. Furthermore, because the diagonal flange extends across the volume of the gutter, debris passing in the gutter to the downspouts is likely to become caught and block the flow of water.

In an attempt to provide greater strength to a gutter bracket, a substantially rigid support bracket of the cantilever type in a plastics gutter system has been proposed by Mitten Solid Vinyl Products. Mitten's support bracket comprises, a vertical mounting plate for fastening to a fascia board, and a member extending laterally therefrom of a substantially cross-shape (+) cross-section extending from proximate the top of such mounting plate. In the Mitten proposal, the lateral member comprises a tapered vertically extending web and a horizontal flange carried between the top and the bottom of the vertically extending web and extending on either side thereof. The end of the vertically extending web, spaced below the horizontal flange carries an opening proximate the mounting plate and carries a vertical flange extending transversely at the bottom of the web towards the mounting plate to provide a longitudinally extending channel opening downwardly and having a reduced entrance to the channel opening. Mitten employs a gutter comprising a longitudinally extending back wall, the top edge of the back wall having an upwardly directed laterally depressible V-shaped projection laterally depressed on the passing of the V-shaped projection through the reduced entrance to the channel expanding into said channel to prevent vertical removal. Due to the bottom portion of the vertical web carrying the opening to create the downwardly opening channel, the top portion of the vertical web (above the horizontal flange) is fused to the mounting plate to rigidify the lateral member against flexing downwardly in relation to the mounting plate when the bracket supports the load of the gutter. When the bracket supports the load of the gutter, the horizontal flange is flush with the top of the gutter. Therefore, the top of the vertical web extends above the top of the gutter. Accordingly, the Mitten gutter must be attached lower on the fascia board to accommodate the height of the vertical web, when mounted spacing the top of the gutter from the roof tiles which normally extend over the fascia board about ½ inch.

With this structure the water can reach the fascia (normally painted or treated wood) weathering it or even penetrating into the wood and thus the building structure.

Other proposals for maximum structural support have supported the gutter from below, encircling a portion of the outer bottom surface of the gutter with a support bracket. However, this proposal is unsightly.

It is therefore an object of this invention to provide an improved gutter system and components therefor, suitable for use in a gutter system constructed of substantially expandable thermoplastics material.

It is a further object of this invention to provide components for a gutter system which permits a plastics gutter system to be mounted close to the edge of the lowest tile of the roof.

Further and other objects of the invention will be apparent to those skilled in the art from the following summary of the invention and detailed description of embodiments thereof.

SUMMARY OF INVENTION

According to one aspect of the invention, a gutter system of expandable and contractable thermoplastics material comprises a plurality of gutter sections for being joined together and a plurality of cantilevered hanger brackets for mounting the sections to a wall, each bracket comprising, a mounting plate for mounting the hanger bracket on a wall, a cantilever member extending therefrom to an end remote the mounting plate, and fastening elements carried by the hanger bracket proximate the mounting plate and the end of the cantilever beam of the hanger bracket remote the mounting plate, the fastening element on the bracket proximate the mounting plate comprising a downwardly opening channel providing a restricted channel mouth portion, each gutter section comprising a bottom and front and rear walls comprising fastening elements for being secured to the fastening elements carried by each hanger bracket, the gutter sections and hanger brackets when secured together further comprising a raised bead or projection between the two spaced from the top of each gutter section, whereby the bead or projection rigidifies the gutter system and permits ease of expansion and contracton of the gutter sections relative to the hanger brackets supporting the gutter sections and the mounting plate spaces the rear wall of the gutter sections from the wall to which the gutter sections are secured to ease expansion and contraction of the gutter sections.

According to another aspect of the invention a gutter section of expandable and contractable plastics material is provided for mounting on a wall, the gutter section comprising front and rear walls and a bottom, each of the front and rear walls carrying fastening elements on the top thereof for being removably secured to complementary fastening elements of a cantilevered hanger bracket carrying a mounting bracket (for example the tops of each of the front and rear walls of the gutter section comprising resiliently deformable lips for being inserted and secured in channels carried by a beam of a hanger bracket by being pressed through restricted channel mouth portions of the hanger bracket) and a raised bead or projection on the inner surface of the rear wall extending in the same direction as the top of the rear wall and spaced therefrom whereby when the cantilevered hanger bracket is secured to the gutter section, portion of the hanger bracket portion proximate the mounting plate of each hanger bracket engages the bead or projection on the rear wall of the gutter to rigidify the structure and permit ease of expansion and contraction of the gutter section relative to any hanger brackets supporting the gutter section and whereby the mounting plate spaces the rear wall of the gutter sections from the wall to ease expansion and contraction of the gutter sections.

According to another aspect of the invention, a gutter system of thermoplastics material comprises a plurality of gutter sections for being joined together and a plurality of cantilevered hanger brackets for mounting the sections, to a wall each hanger bracket comprising, a mounting plate for mounting the hanger bracket on a wall, a cantilevered member extending therefrom to an end remote the mounting plate, and fastening elements carried by the hanger bracket proximate the mounting plate and the end of the cantilevered member of the hanger bracket remote the mounting plate, the fastening element on the bracket proximate the mounting plate comprising a downwardly opening channel providing a restricted channel mouth portion, each gutter section comprising a bottom and front and rear walls, the front and rear walls comprising fastening elements for being secured to the fastening elements carried by the hanger, bracket each gutter section further comprising a raised bead or projection on the inner surface of the rear wall extending in the same direction as the top of the gutter section and spaced therefrom whereby when the hanger brackets are secured to the gutter sections by the securing of the fastening elements of the hanger brackets and fastening elements, of the gutter sections a hanger bracket portion of each hanger bracket proximate the mounting plate engages the bead or projection on the rear wall to rigidify the gutter sytem and permit ease of expansion and contraction of the gutter sections relative to the hanger brackets supporting the gutter sections, and the mounting plate spaces the rear wall of the gutter sections from the wall to which the gutter sections are secured to ease expansion and contraction of the gutter sections.

According to another aspect of the invention, a gutter system of thermoplastics expandable and contractable material for mounting to a wall, the gutter system comprising plurality of gutter sections for being joined together and a plurality of hanger brackets for mounting the sections to the wall, each hanger bracket comprising, a mounting plate for mounting the hanger bracket to the wall, a beam secured to the mounting plate and extending therefrom to an end remote the mounting plate, a downwardly opening channel carried by the beam proximate the mounting plate, the channel having a reduced or restricted mouth portion for receiving and securing a resiliently deformable lip carried on the top of the rear wall of each gutter section which lip deforms when pressed through the mouth of the channel into the channel and resiliently restore for locking in the channel, the beam preferably being in the form of an I-beam and more preferably in the form of a modified I-beam being triangular in shape with a taller web portion proximate the mounting plate than remote the mounting plate, each gutter section comprising front and rear walls and a bottom, the top of the rear wall carrying a resiliently deformable lip (preferably in the form of V-shaped lips) for being inserted and secured in the channel by being pressed through the restricted channel mouth portion into the channel to return therein to its normal configuration and be precluded from being removed until resiliently depressed to be removed through the channel mouth, complementary fastening elements at the end of the beam remote the mounting plate and on top of the front wall of the gutter for securing together, and a raised bead or projection on the inner surface of the rear wall extending in the same direction as the lip carried on the top of the rear wall and spaced therefrom whereby when the lip is in the channel, and the complementary fastening elements secured, the beam portion proximate the mounting plate of each hanger bracket engages the bead or projection on the rear wall of the gutter to rigidify the structure and permit ease of expansion and contraction of the gutter section relative to any hanger brackets supporting the gutter section and the mounting plate spaces the rear wall of the gutter sections from the wall to which the gutter system is secured to ease expansion and contraction of the gutter sections.

Preferably, each of the gutter sections is formed by an extrusion process.

Preferably the channel proximate the mounting plate opens downwardly with the restricted mouth portion below a channel and the channel is provided proximate the end of the beam remote the mounting plate which opens upwardly with a restricted mouth portion above the channel. In this event, the lip on the rear wall of the gutter is inserted and secured in the downwardly opening channel proximate the mounting plate by pushing the lip up through the channel mouth into the channel and a lip is provided on the front wall which is inserted and secured in the upwardly opening channel proximate the end of the beam by pushing the lips down through the channel mouth into the channel. Where the lip of the front wall of the gutter is inserted into the upwardly opening channel proximate the end of the beam of the hanger bracket remote the mounting plate, the front wall may extend above the top of the end of the beam of the hanger bracket when the hanger bracket is secured to the gutter section and the lip may extend downwardly from the front wall for being secured into the upwardly opening channel.

Therefore to secure the components together, the mounting plate of each hanger bracket is secured to the fascia immediately below the tile of the roof and in one embodiment the lips of the gutter are "snapped" into the channels by resiliently deforming the lips as they pass through the restricted channel openings which restore to their initial configuration when they pass into the channel.

According to another aspect of the invention, a plastics hanger bracket for mounting a plastics gutter system is provided, the hanger bracket comprising a mounting plate for mounting the hanger bracket on a wall, the mounting plate carrying at least one aperture therethrough for mounting the bracket to the wall a beam secured to the mounting plate, the at least one aperture at approximately the same level as the beam is on the mounting plate a pair of channels having reduced mouth portions carried between the beam and mounting plate, and proximate the end of the beam remote the mounting plate for receiving and securing resiliently deformable lips carried on the top of the front and rear walls of plastic gutter sections which lips deform when pressed through the mouth of the channel into the channel where they resiliently restore to their normal position to lock in the channel, the beam preferably being in the form of an I-beam and more preferably in the form of a modified I-beam being triangular in shape with a wider beam portion proximate the mounting plate than remote the mounting plate, the channel between the beam and mounting plate opening downwardly.

According to another aspect of the invention, a gutter section of expandable and contractable plastics material is provided for mounting on a wall, the gutter section comprising front and rear walls and a bottom, the tops of each of the front and rear walls comprising resiliently deformable lips for being inserted and secured in channels carried by a beam of a hanger bracket by being pressed through restricted channel mouth portions of the hanger bracket leading into channels to restore therein to their normal position and be precluded from being removed until resiliently laterally depressed to be removed through the channel mouth, the lip on the front wall being directed downwardly and the lip on the rear wall being directed upwardly and a raised bead or projection on the inner surface of the rear wall extending in the same direction as the lips on the top of the rear wall and spaced therefrom whereby when the lips are in the channels, the beam proximate the mounting plate of each hanger bracket engages the bead or projection on the rear wall of the gutter to rigidify the structure and permit ease of expansion and contraction of the gutter section relative to any hanger brackets supporting the gutter section.

According to another aspect of the invention, a gutter system and components therefor of thermoplastics expandable and contractable material are provided for securing to a wall comprising a plurality of gutter sections to be connected together and a plurality of hanger brackets for mounting the sections, each hanger bracket being of the cantilever type and comprising a back mounting plate and a tapered I-beam connected to, and extending laterally away from, the back mounting plate, a downwardly opening channel spacing the back mounting plate from a portion of the tapered I-beam and having a reduced entrance (mouth opening) to the channel opening, a bearing surface on the modified tapered I-beam below the reduced entrance to the channel which channel is above the entrance and spaced from the mounting plate, the modified tapered I-beam further carrying a channel on the end of the tapered I-beam remote the mounting plate, this channel also having a reduced entrance to the channel, each gutter section comprising a longitudinally extending back wall, a bottom, and a front wall, the top edge of the back wall having an upwardly directed laterally depressible V-shaped projection, the top edge of the front wall having a laterally depressible V-shaped projection (either directed upwardly or downwardly), both back and front projections extending longitudinally of the gutter section to be laterally depressed when pushed past the reduced entrance of the channel and on passing through the reduced entrance of each hanger bracket channel, restoring to its initial configuration in said channel to prevent vertical removal thereof, and a longitudinally extending bead spaced below the top edge of the back wall against which bead the bearing surface of the hanger bracket abuts when the bracket supports the load of the gutter to rigidify the structure and permit ease of expansion and contraction of the gutter sections relative to the hanger brackets and whereby the mounting plate spaces the rear wall of the gutter sections from the wall to ease expansion and contraction of the gutter sections.

According to another aspect of the invention, the tapered I-beam may comprise a modified tapered I-beam comprising a tapered central vertical web tapering in the direction away from the mounting plate, a top substantially horizontally extending flange carried on the top of the web and a bottom generally upwardly inclined flange carried on the bottom of the web, the top and bottom flanges each extending from both sides of the web. In this aspect, the downwardly opening channel extending longitudinally between the back mounting plate and a portion of the tapered I-beam is defined by the back mounting plate and a flange carried on the tapered central vertical web proximate the mounting plate, the orientation of the last flange from its bottom to its top, sloping upwardly angularly towards the back mounting plate, then transversely away from the back mounting plate, and then curving towards the back mounting plate, to provide, the bearing surface for abutting the longitudinally extending bead of the gutter, the reduced channel opening and a wider channel portion proximate the channel opening. According to this aspect of the invention, the back mounting plate and the tapered I-beam may be joined at the upper end of the channel proximate the top substantially horizontally extending flange, or by an extension of that flange to the mounting plate.

The top edges of the back and front walls of the gutter, upon seating in the longitudinally extending channels, are preferably flush with the top flange of the tapered I-beam of the hanger bracket. This permits the top of the hanger bracket to seat flush with the top profile of the gutter. To prevent the beam of the hanger from flexing downwardly in relation to the mounting plate when the bracket supports the load of the gutter, the bearing surface of the lateral member abuts the longitudinally extending bead spaced below the top edge of the back wall of the gutter. Accordingly, the gutter may be mounted on the fascia board in close proximity to the roof tiles which extend over the fascia board. Water is thereby prevented from penetrating into the building and a more attractive facade is provided.

The invention will now be illustrated with reference to the following drawings of an embodiment of the invention and detailed description thereof.

BRIEF DESCRIPTION OF THE DRAWINGS

FIG. 7 is a perspective view of part of a gutter section with a connector.

FIG. 8 is a top view of part of two gutter sections joined by a connector.

DESCRIPTION OF PREFERRED EMBODIMENT OF THE INVENTION

Figure 1:
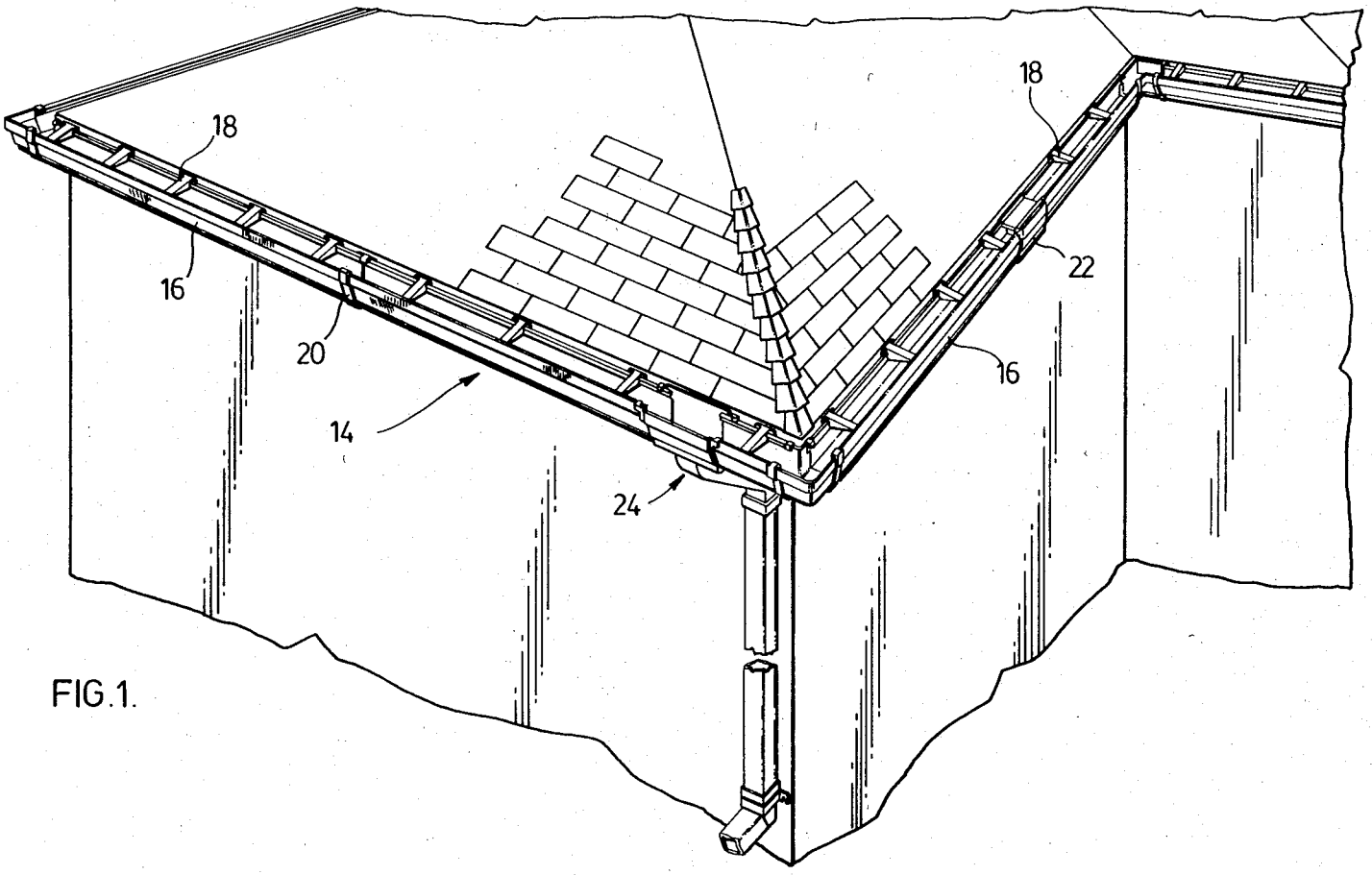
FIG. 1 is a perspective view of a gutter system and components therefor shown attached to the fascia board of the eaves of a house according to the embodiment of the invention.
Figure 2:
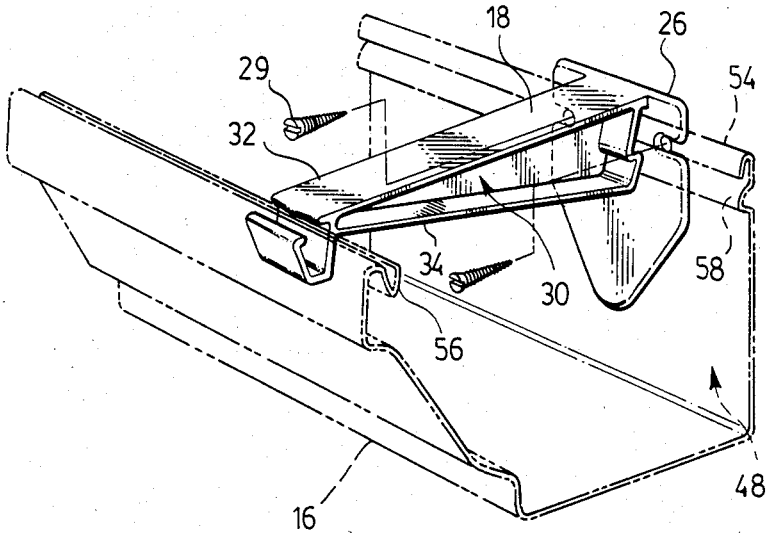
FIG. 2 is a perspective view of a gutter and hanger bracket secured thereto.
Figure 3:
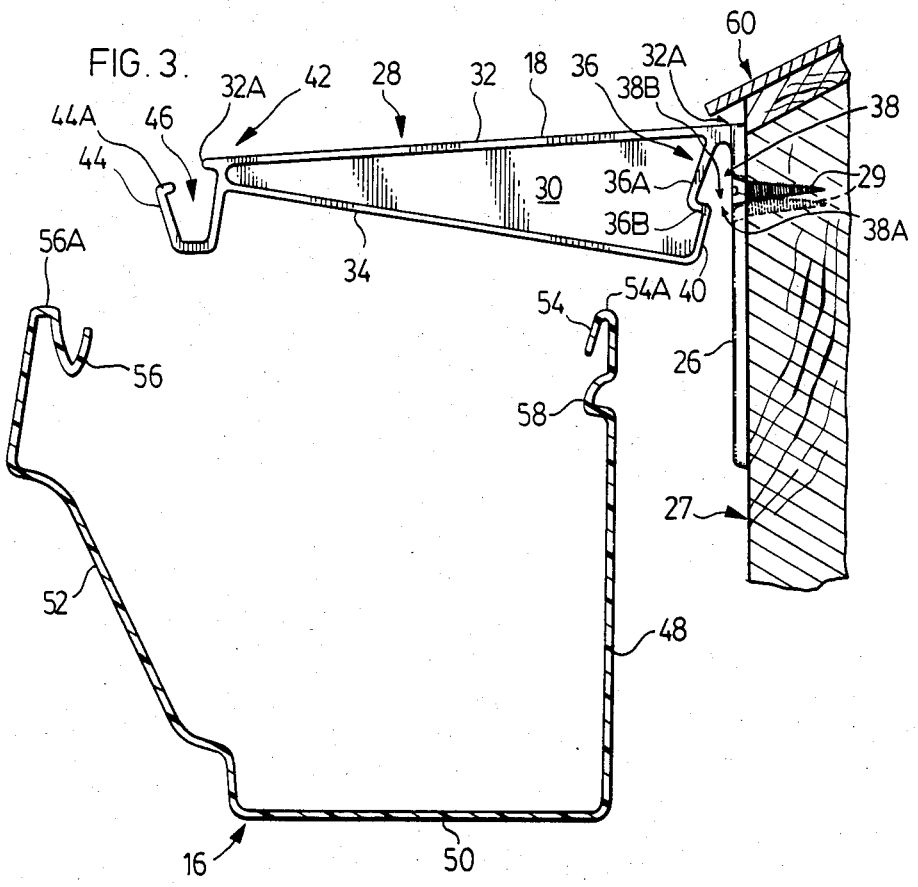
FIG. 3 is a cross-sectional view of the gutter section and a hanger bracket shown in FIG. 2 mounted on a fascia board.

With reference to FIG. 1, gutter system 14 is shown comprising a plurality of plastic gutter sections 16, a plurality of plastic hanger brackets 18, plastic connectors 20, a plastic expansion coupling 22 and a plastic downspout assembly 24.

With reference to FIGS. 1, 2, 3, 4, and 5, hanger brackets 18 are shown secured to the fascia 27 (see FIG. 3) of the exterior of the house immediately below the roof tiles 60 supporting individual gutter sections 16 connected one to the other and to expansion coupling 22 and downspout assembly 24. Each hanger bracket 18 is of the cantilever type and comprises a back mounting plate 26, and a tapered I-beam 28 connected thereto. Mounting plate 26 is affixed to fascia board 27 of the eaves of the house by screws 29. Tapered I-beam 28 comprises tapered central vertically extending web 30 carrying top substantially horizontally extending flange 32 and extension 32A for connecting tapered beam 28 to mounting plate 26 (see FIG. 3). Web 30 also carries bottom generally upwardly inclined flange 34 (inclined upwardly in a direction away from mounting plate 26) and generally vertically extending flange 36, the orientation of which flange from the lower part, to the upper part, of flange 36, slopes upwardly angularly towards mounting plate 26 (providing bearing surface 40), then generally transversely away from mounting plate 26 to provide portion 36B and then curving towards the mounting plate (36A) joining extension 32A of flange 32 to define between flange 36 and mounting plate 26 a downwardly opening channel 38 providing restricted channel mouth portion (reduced mouth entrance) 38A and wider channel portion 38B immediately above mouth 38A. Tapered end 42 of tapered I-beam 28 comprises portion 32A being an extension of top flange 32 which overextends web 30 and U-shaped channel member 44 comprising channel 46 having a reduced entrance between portion 32A and lip 44A.

Each gutter section 16 comprises longitudinally extending back wall 48, bottom 50 and front wall 52. Back wall 48 has upwardly directed laterally depressible V-shaped projection 54 which extends longitudinally on the top of back wall 48. Front wall 52 carries downwardly directed laterally depressible V-shaped projection 56 which extends longitudinally of front wall 52 suspended from lip 56A secured to the top edge of wall 52.

Both back projection 54 and front projection 56 extend longitudinally of gutter 16 to be laterally depressed on passing through reduced entrances 38A into channel 38B and between lips 44A and 32A into channel 46 respectively of each hanger bracket 18.

Figure 4:
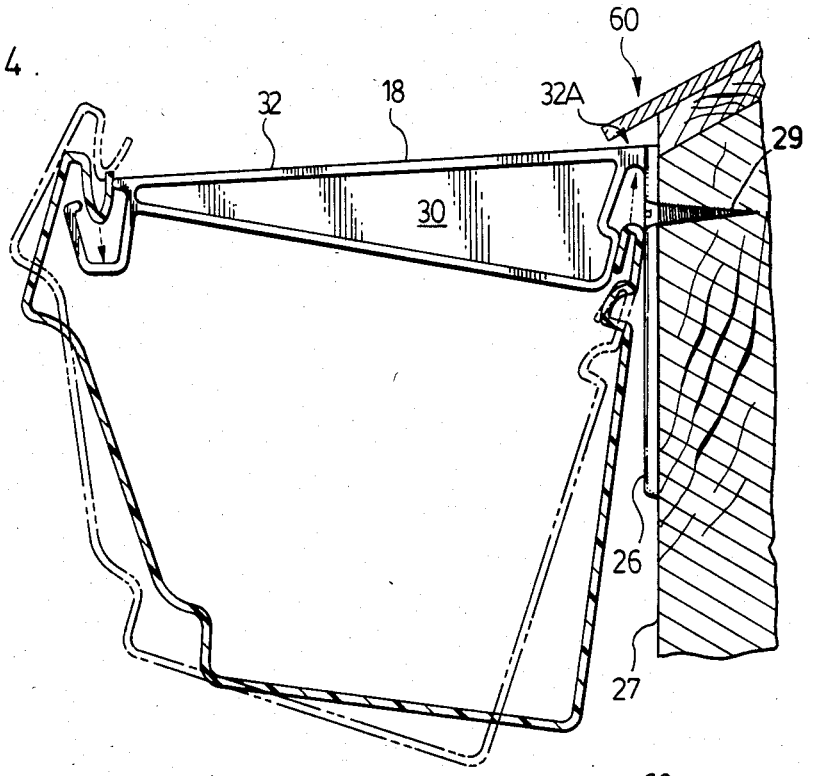
FIGS. 4 and 5 illustrate the mounting of the gutter section to the hanger bracket.
Figure 5:
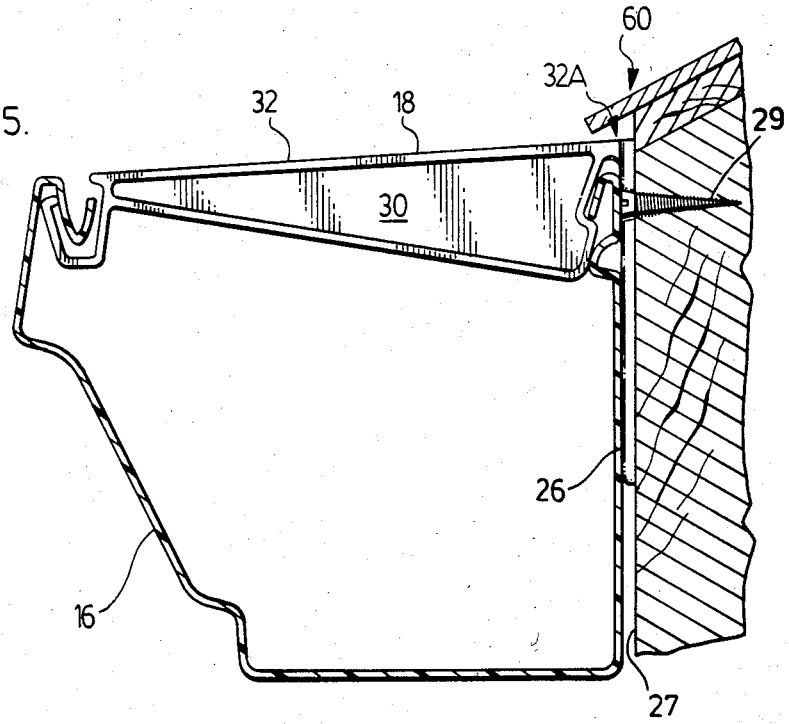

Back wall 48 of each gutter 16 comprises a longitudinally extending bead (projection) 58, spaced below the upper edge 54A of V-shaped projection 54 against which bead 58, the bearing surface 40 of each hanger 18 abuts when the hanger 18 supports each gutter 16 when connected thereto thereby rigidifying the assembled structure. The bead (projection) 58 also minimizes contact of the hanger bracket with the back wall 48 thereby easing expansion and contraction of the gutter section relative to the hanger bracket. When a hanger bracket 18 is secured to a gutter section 16, the structure is of low profile (flange 32 of tapered I-beam being minimally above the top edge 54A of gutter 16) thereby permitting minimal spacing from the roof tiles 60 when mounted. The combination of the bearing surface 40 of flange 36 abutting the bead 58 rigidifies the cantilever structure and prevents tapered I-beam 28 from flexing downwardly in relation to the mounting plate 26 when bracket 18 supports the load of the gutter section 16. Additionally, because of the manner of mounting, nothing interferes with fluid flowing through each gutter section 16. Furthermore, back wall 48 of each gutter 16 abuts mounting plate 26, thus spacing the gutter section from fascia 27 (see FIG. 3), thus easing the expansion and contraction of the gutter sections 16 due to temperature variations. With reference to FIGS. 4 and 5, each gutter section 16 is secured to each hanger bracket 18 (after securing hanger bracket 18 to the fascia board 27 by passing screw 29 through fascia board 27 immediately below roof tiles 60) by snapping V-shaped laterally depressible projection 54 past mouth 38A into channel 38B where it becomes locked because the width of the lip 54 is normally greater in width than the reduced mouth opening 38A. Thereafter downwardly directed V-shaped laterally depressible projection is passed through lips 44 and 32A into channel 46, where the lips restore to their initial position locking the projection 56 in channel 46 (because the width of the lip when not depressed laterally is greater than the space between the lips 44A and 32A).

Figure 6:
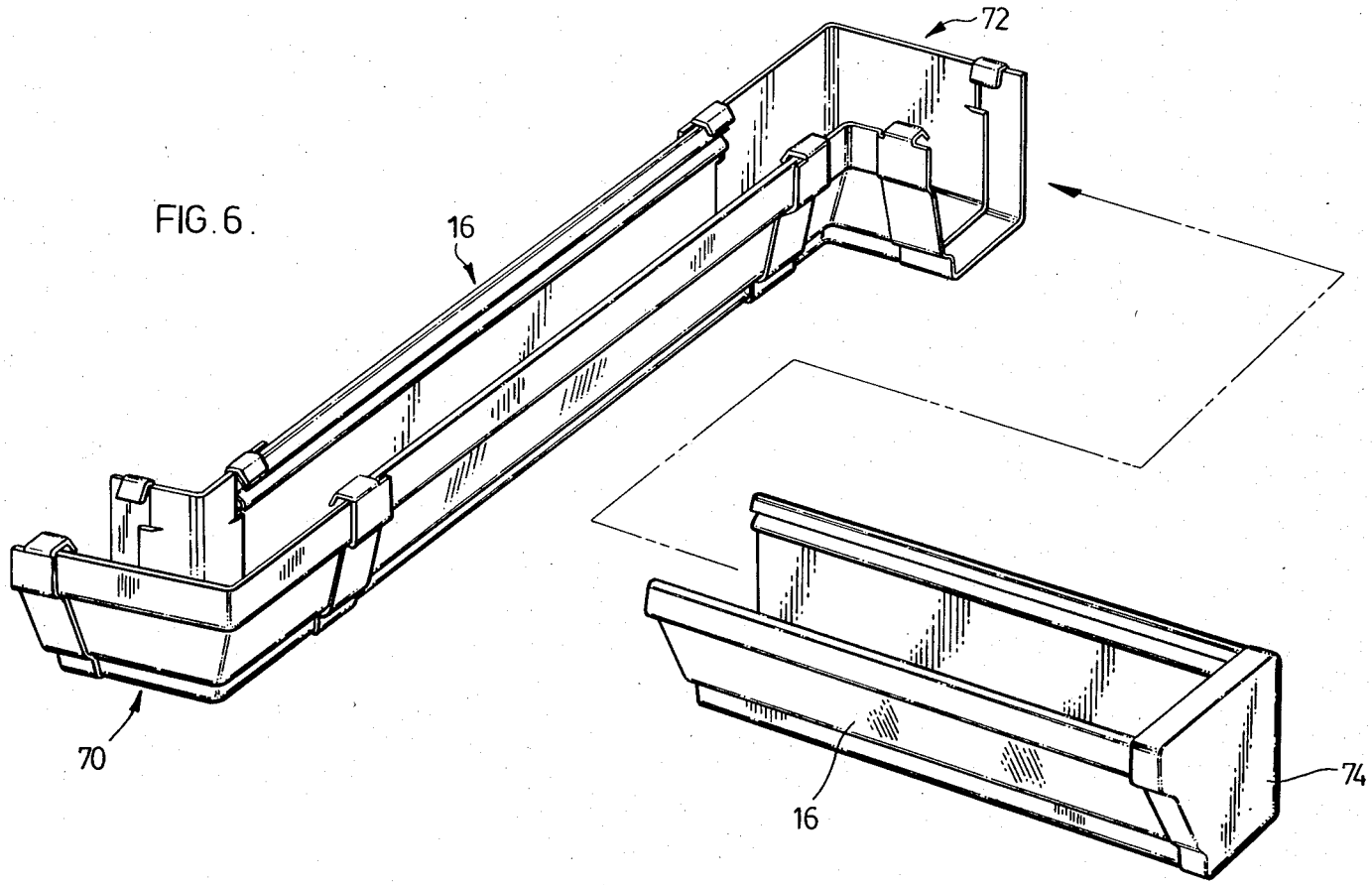
FIG. 6 is a perspective view partially disassembled of the combination of gutter sections with cornerpieces with integral connector.

With reference to FIGS. 7 and 8, gutter sections 16 may be attached, one abutting the other, by connectors 20. Each connector 20 comprises a web 64 spacing two channels 62 of the same configuration as the cross-section of each gutter section 16 (see FIG. 7), each channel 62 opening longitudinally in opposite longitudinal directions to receive the ends of two adjacent sections 16 which abut each side of web 64. Channel 62 is defined by flanges, 66,68 spaced by web 64. With reference to FIG. 6, outside corner gutters 70 and inside corner gutters 72 (see FIG. 6) may be attached to gutter segments 16 also by integral connectors each carrying one channel of the same configuration as channel 62 for receiving one gutter section. A gutter section 16 is used to be the end section and is covered by end piece (cap) 74 of the same cross-sectional configuration as each gutter segment 16 to cap the end of a gutter segment 16.

Figure 9:
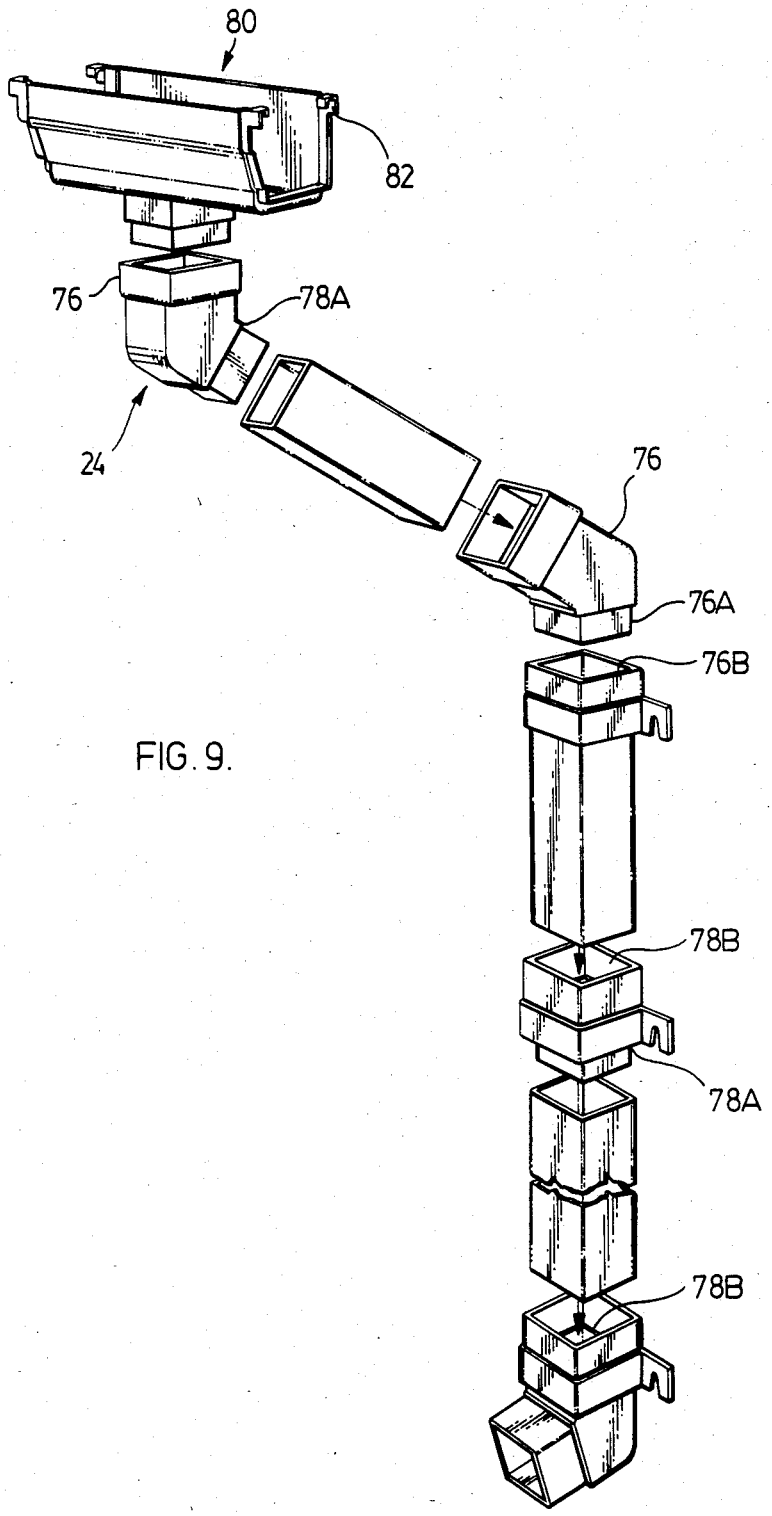
FIG. 9 is a perspective view of a downspout assembly comprising a combination of downspout segments, coupling segments therefor and a gutter downspout for connecting a gutter to a downspout.
Figure 10:
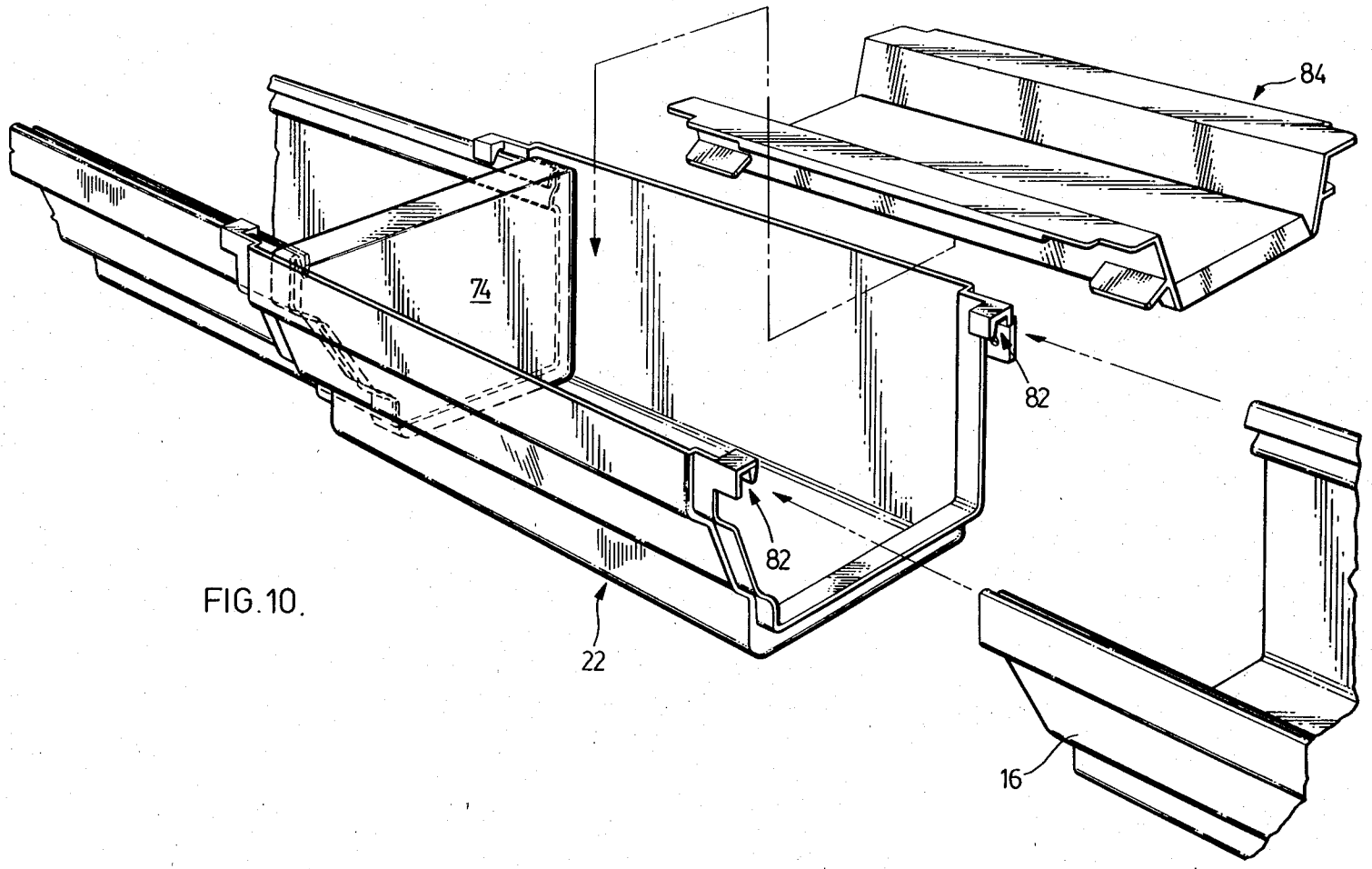
FIG. 10 is a perspective view of gutter sections which are secured in a gutter expansion coupling and cover therefor.
Figure 11:
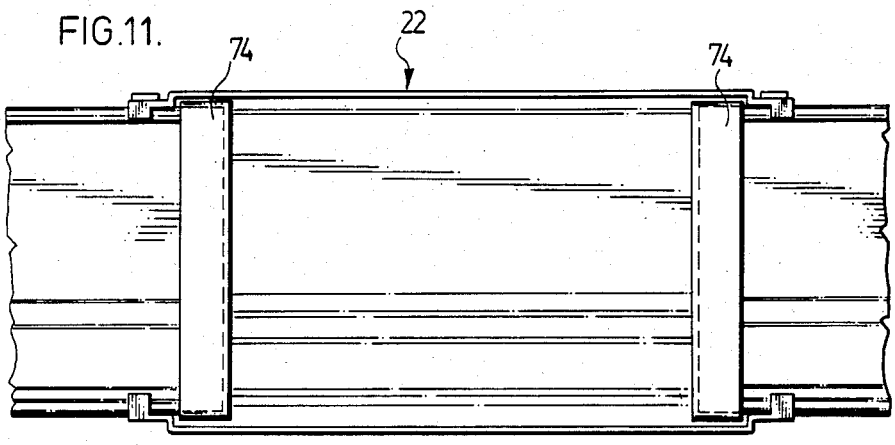
FIG. 11 is a top view of the gutter sections and expansion coupling shown in FIG. 10, without the cover for the expansion coupling.
Figure 12:
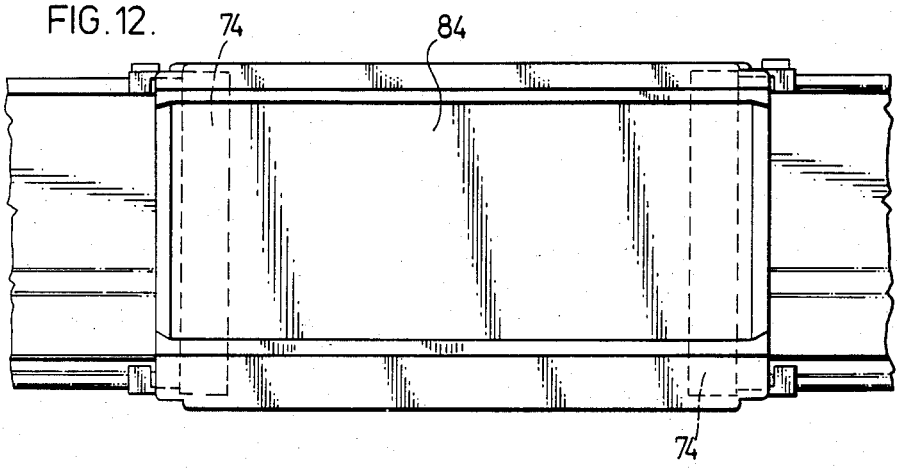
FIG. 12 is a top view of the gutter sections and expansion coupling shown in FIG. 10, with the cover for the expansion coupling in place.
Figure 13:
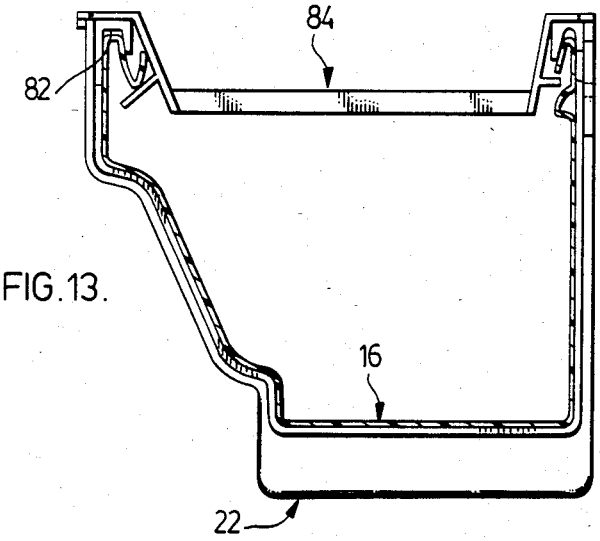
FIG. 13 is a cross-sectional view of a gutter section extending into an expansion coupling with the cover for the expansion coupling in place, shown in FIG. 10.

With reference to FIG. 9, downspout assembly 24 comprises a combination of downspout 76 of suitable length and/or curvature. Downspout segments comprise suitable combinations of male 76A, and female 76B, ends to provide segments which are telescopically engageable with respect to one another. Ends 76A, 76B are provided with a circumferential lip or edge 78A,78B to limit the extent to which segments 76 are engageable telescopically. Downspout assembly 24 also comprises downspout expansion coupling for joining sections 16 to downspouts 76. (See FIGS. 1 and 9)

Because the gutter system components are constructed from thermoplastic materials having a high co-efficient of expansion, components permitting expansion and contraction must be provided. Because of the configurations of the channels 38 and 46 of hanger brackets 18 and gutter sections 16, expansion and contraction of gutter sections 16 is not interfered with. Additionally, downspout expansion coupling 80 and expansion coupling 22 connecting sections 18 do not interfere with the expansion and contraction of sections 16. Particularly adjacent section 16 projects into each coupling overlying a portion thereof and slides with respect to such portion (see FIGS. 10 through 13 inclusive). A sufficient number of couplings 80,22 are spaced in the length of a plurality of abutting gutter sections 16 to allow for expansion and contraction of such segments 16 along any length of gutter.

When employed, expansion coupling 22 is affixed to the fascia board 27 slightly elevated from the position of downspout expansion coupling 80, to ensure that all water flowing into gutter segments 16 will drain into downspout assembly 24. Couplings 22 and 80 each have an inside cross-sectional configuration corresponding substantially to the outside cross-sectional configuration of gutter section 16. Downwardly and laterally opening channels 82 of couplings 22 and 80 extend longitudinally to slideably receive the top edges 54A,56A of the gutter section and prevent vertical removal of the gutter section 16. Each section 16 extending into expansion coupling 22 is capped and sealed by cap 74. Therefore, no water enters section 22, its sole purpose being to permit expansion and contraction of the gutter system including section 16. Therefore cap 84 is secured to cover expansion coupling 22 to prevent water from entering and accumulating in the bottom of expansion coupling 22.

As many changes can be made to the embodiment without departing from the scope of the invention, it is intended that all material contained herein be interpreted as illustrative of the invention and not in a limiting sense.

The embodiments of the invention in which an exclusive property or privilege is claimed are as follows:

1. A gutter system of thermoplastics expandable and contractable material for mounting to a wall, the gutter system comprising a plurality of gutter sections for being joined together and a plurality of hanger brackets for mounting the sections to the wall, each hanger bracket comprising a mounting plate for mounting the hanger bracket to the wall, a beam secured to the mounting plate and extending therefrom to an end remote the mounting plate, a downwardly opening channel carried by the beam proximate the mounting plate, the channel having a reduced or restricted mouth portion for receiving and securing a resiliently deformable lip carried on the top of the rear wall of each gutter section which lip deforms when pressed through the mouth of the channel into the channel and resiliently restores for locking in the channel, the gutter comprising front and rear walls and a bottom, the top of the rear wall carrying a resiliently deformable lip for being inserted and secured in the channel by being pressed through the restricted channel mouth portion into the channel to restore therein to its normal configuration and be precluded from being removed until resiliently depressed to be removed through the channel mouth, complementary fastening elements at the end of the beam remote the mounting plate and on top of the front wall of the gutter for securing together, and a raised bead or projection on the inner surface of the rear wall extending in the same direction as the lip carried on the top of the rear wall and spaced therefrom whereby when the lip is in the channel, and the complementary fastening elements secured, the beam portion proximate the mounting plate of each hanger bracket engages the bead or projection on the rear wall of the gutter to rigidify the structure and permit ease of expansion and contraction of the gutter sections relative to the hanger brackets supporting the gutter sections, and the mounting plate spaces the rear wall of the gutter sections from the wall to which the gutter system is secured to ease expansion and contraction of the gutter sections.

2. The gutter system of claim 1, wherein the beam is in the form of an I-beam.

3. The gutter system of claim 1, wherein the beam is in the form of an I-beam triangular in shape with a taller web portion proximate the mounting plate than remote the mounting plate.

4. The gutter system of claim 1, wherein the resiliently deformable lip is V-shaped.

5. The gutter system of claim 2, wherein the resiliently deformable lip is V-shaped.

6. The gutter system of claim 3, wherein the resiliently deformable lip is V-shaped.

7. The gutter system of claim 1, wherein each of the gutter sections is formed by extrusion.

8. The gutter system of claim 2, wherein each of the gutter sections is formed by extrusion.

9. The gutter system of claim 3, wherein each of the gutter sections is formed by extrusion.

10. The gutter system of claim 4, wherein each of the gutter sections is formed by extrusion.

11. The gutter system of claim 5, wherein each of the gutter sections is formed by extrusion.

12. The gutter system of claim 6, wherein each of the gutter sections is formed by extrusion.

13. The gutter system of claim 1, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

14. The gutter system of claim 2, wherein the fastening element at the end of the beam comprises a channel proximate the end of the beam remote the mounting plate opening upwardly with a restrictive mouth portion above the channel and a lip is provided on the front wall of each gutter section for insertion into the upwardly opening channel proximate the end of the beam by pushing the lip down through the channel mouth into the channel.

15. The gutter system of claim 3, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

16. The gutter system of claim 4, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

17. The gutter system of claim 5, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

18. The gutter system of claim 6, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

19. The gutter system of claim 7, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

20. The gutter system of claim 8, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

21. The gutter system of claim 9, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

22. The gutter system of claim 10, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

23. The gutter system of claim 11, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

24. The gutter system of claim 12, wherein the fastening element at the end of the beam comprises a channel proximate the end of the beam remote the mounting plate opening upwardly with a restricted mouth portion above the channel and a lip is provided on the front wall of each gutter section for insertion into the upwardly opening channel proximate the end of the beam by pushing the lip down through the channel mouth into the channel.

25. A plastics hanger bracket for mounting a plastics gutter system, the hanger bracket comprising a mounting plate for mounting the hanger bracket on a wall, the mounting plate carrying at least one aperture therethrough for mounting the bracket to the wall, a beam secured to the mounting plate, the at least one aperture at approximately the same level as the beam is on the mounting plate, a pair of channels having reduced mouth portions carried between the beam and mounting plate, and proximate the end of the beam remote the mounting plate, for receiving and securing resiliently deformable lips carried on the top of front and rear walls of plastic gutter sections which lips deform when pressed through the mouth of the channel into the channel where they resiliently restore to their normal position to lock in the channel, the channel between the beam and mounting plate opening downwardly.

26. The hanger bracket of claim 25, wherein the beam is in the form of an I-beam.

27. The hanger bracket of claim 25, wherein the beam is in the form of a modified I-beam being triangular in shape with a wider beam portion proximate the mounting plate than remote the mounting plate.

28. The hanger bracket of claim 25, wherein the channel proximate the end of the beam remote the mounting plate opens upwardly and has a restricted mouth portion above the channel.

29. The hanger bracket of claim 26, wherein the channel proximate the end of the beam remote the mounting plate opens upwardly and has a restricted mouth portion above the channel.

30. The hanger bracket of claim 27, wherein the channel proximate the end of the beam remote the mounting plate opens upwardly and has a restricted mouth portion above the channel.

31. A gutter section of expandable and contractable plastics material for mounting on a wall, the gutter section comprising front and rear walls and a bottom, the tops of each of the front and rear walls comprising resiliently deformable lips for being inserted and secured in channels carried by a beam of a hanger bracket by being pressed through restricted channel mouth portions of the hanger bracket leading into the channels to restore therein to their normal position and be precluded from being removed therefrom until resiliently laterally depressed to be removed through the channel mouth, the lips on the front wall being directed downwardly and the lips on the rear wall being directed upwardly, and a raised bead or projection on the inner surface of the rear wall extending in the same direction as the lip on the top of the rear wall and spaced therefrom whereby when the lips are in the channels, the beam proximate the mounting plate of each hanger bracket engages the bead or projection on the rear wall of the gutter to rigidify the structure and permit ease of expansion and contraction of the gutter section.

32. A gutter system of thermoplastics expandable and contractable material for securing to a wall, comprising a plurality of gutter sections to be connected together and a plurality of hanger brackets for mounting the sections, each hanger bracket being of the cantilever type and comprising a back mounting plate and a tapered I-beam connected to, and extending laterally away from, the back mounting plate, a downwardly opening channel between the back mounting plate and the laterally extending member and having a reduced entrance to the channel narrower than a wider portion adjacent the reduced entrance within the channel, the modified tapered I-beam having a bearing surface on the modified tapered I-beam below the reduced entrance to the channel, and spaced from the mounting plate, the modified tapered I-beam further carrying a channel on the end of the tapered I-beam remote the mounting plate, this channel also having a reduced entrance to the channel, each gutter section comprising a longitudinally extending back wall, a bottom, and a front wall, the top edge of the back wall having an upwardly directed laterally depressible V-shaped projection, the top edge of the front wall having a laterally depressible V-shaped projection, both back and front projections extending longitudinally of the gutters to be laterally depressed when pushed past the reduced entrance of the channel, and on passing through the reduced entrance of each hanger bracket channel, restoring to its initial configuration in said channel upon entering the channel to prevent vertical removal thereof, and a longitudinal extending bead spaced below the top edge of the back wall against which bead the bearing surface of the hanger bracket abuts when the bracket supports the load of the gutter, to rigidify the structure and permit ease of expansion and contraction of the gutter sections relative to the hanger brackets and whereby the mounting plate spaces the rear wall of the gutter sections from the wall to ease expansion and contraction of the gutter sections.

33. The gutter system of claim 32, wherein the laterally depressible V-shaped projection on the front wall is directed downwardly.

34. The gutter system of claim 32, wherein the tapered I-beam comprises a modified tapered I-beam comprising a tapered central vertical web tapering in the direction away from the mounting plate, a top substantially horizontally extending flange carried on the top of the web, and a bottom generally angularly upwardly inclined flange which top and bottom flanges extend from both sides of the web, the downwardly opening channel extending longitudinally between the back mounting plate and a portion of the tapered I-beam being defined by the back mounting plate and a flange carried on the tapered central vertical web proximate the mounting plate, the configuration of the last flange from the bottom to the top thereof being oriented to slope angularly upwardly towards the back mounting plate then transversely away from the back mounting plate and then curving towards the back mounting plate, to provide, the bearing surface for abutting the longitudinally extending bead of the gutter, the reduced channel opening, and a wider portion proximate the channel opening.

35. The gutter system of claim 33, wherein the tapered I-beam comprises a modified tapered I-beam comprising a tapered central vertical web tapering in the direction away from the mounting plate, a top substantially horizontally extending flange carried on the top of the web, and a bottom generally angularly upwardly inclined flange which top and bottom flanges extend from both sides of the web, the downwardly opening channel extending longitudinally between the back mounting plate and a portion of the tapered I-beam being defined by the back mounting plate and a flange carried on the tapered central vertical web proximate the mounting plate, the configuration of the last flange from the bottom to the top thereof being oriented to slope angularly upwardly towards the back mounting plate then transversely away from the back mounting plate and then curving towards the back mounting plate, to provide, the bearing surface for abutting the longitudinally extending bead of the gutter, the reduced channel opening, and a wider portion proximate the channel opening.

36. The gutter system of claim 34, wherein the back mounting plate and the tapered I-beam are joined at the upper end of the channel proximate the top substantially horizontally extending flange or by an extension of that flange to the mounting plate.

37. The gutter system of claim 35, wherein the back mounting plate and the tapered I-beam are joined at the upper end of the channel proximate the top substantially horizontally extending flange or by an extension of that flange to the mounting plate.

38. A gutter section of plastics material comprising front and rear walls and a bottom, the front and rear walls carrying fastening elements for being removably secured to complementary fastening elements of a hanger bracket and a raised bead or projection on the inner surface of the rear wall extending in the same direction as the top of the rear wall and spaced therefrom so that when a hanger bracket is secured to the gutter section, the hanger bracket engages the bead or projection on the rear wall of the gutter to rigidify the structure and permit ease of expansion and contraction of the gutter section relative to any hanger brackets supporting the gutter section.

39. The gutter section of claim 38, wherein the tops of each of the front and rear walls of the gutter section comprise resiliently deformable lips for being inserted and secured in channels carried by a beam of a hanger bracket by being pressed through restricted channel mouth portions of the hanger bracket.

40. A gutter system of thermoplastics material comprising a plurality of gutter sections for being joined together and a plurality of hanger brackets for mounting the sections, each hanger bracket comprising, a mounting plate for mounting the hanger bracket on a wall, a member extending therefrom to an end remote the mounting plate, and fastening elements carried by the hanger bracket proximate the mounting plate and the end of the hanger bracket remote the mounting plate, and each gutter section comprises a bottom and front and rear walls, the front and rear walls comprising complementary fastening elements for being secured to the fastening elements carried by the hanger, each gutter section further comprising a raised bead or projection on the inner surface of the rear wall extending in the same direction as the top of the gutter section and spaced therefrom so that when the hanger bracket is secured to the gutter by the securing of the fastening elements and complementary fastening elements, a larger bracket portion proximate the mounting plate engages the bead or projection on the rear wall to rigidify the structure and permits ease of expansion and contraction of the gutter section relative to any hanger brackets supporting the gutter section.

41. A gutter system of expandable and contractable thermoplastics material comprising a plurality of gutter sections for being joined together and a plurality of cantilevered hanger brackets for mounting the sections to a wall, each hanger bracket comprising, a mounting plate for mounting the hanger bracket on a wall, a cantilever member extending therefrom to an end remote the mounting plate, and fastening elements carried by the hanger bracket proximate the mounting plate and the end of the cantilever beam of the hanger bracket remote the mounting plate, the fastening element on the bracket proximate the mounting plate comprising a downwardly opening channel providing a restricted channel mouth portion, each gutter section comprising a bottom and front and rear walls comprising fastening elements for being secured to the fastening elements carried by each hanger bracket, the gutter sections and hanger brackets when secured together further comprises a raised bead or projection between the two spaced from the top of each gutter section whereby the bead or projection rigidifies the gutter system and permits ease of expansion and contraction of the gutter sections relative to the hanger brackets supporting the gutter sections and the mounting plate spaces the rear wall of the gutter sections from the wall to which the gutter sections are secured to ease expansion and contraction of the gutter sections.

* * * * *

UNITED STATES PATENT AND TRADEMARK OFFICE

CERTIFICATE OF CORRECTION

PATENT NO. : 4,632,342

DATED : December 30, 1986

INVENTOR(S) : James Skinner

It is certified that error appears in the above-identified patent and that said Letters Patent is hereby corrected as shown below:

Claim 40, Col. 16, line 4, the word 'larger' is struck and the word hanger substituted therefor.

Signed and Sealed this

Twenty-first Day of April, 1987

*Attest:*

DONALD J. QUIGG

*Attesting Officer*

*Commissioner of Patents and Trademarks*